US008627902B2

(12) United States Patent
Hammer et al.

(10) Patent No.: US 8,627,902 B2
(45) Date of Patent: Jan. 14, 2014

(54) ESTIMATING DRILL CUTTING ORIGINATION DEPTH USING MARKING AGENTS

(75) Inventors: Aaron C. Hammer, Houston, TX (US); Dennis K. Clapper, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 225 days.

(21) Appl. No.: 13/167,342

(22) Filed: Jun. 23, 2011

(65) Prior Publication Data

US 2012/0325465 A1 Dec. 27, 2012

(51) Int. Cl.
*E21B 47/04* (2012.01)

(52) U.S. Cl.
USPC ..... 175/42; 166/250.12

(58) Field of Classification Search
USPC ..... 175/42; 166/250.12
See application file for complete search history.

(56) References Cited

U.S. PATENT DOCUMENTS

| | | | | |
|---|---|---|---|---|
| 3,205,353 | A | 9/1965 | Bray | |
| 3,566,979 | A | 3/1971 | Bennett et al. | |
| 4,447,340 | A * | 5/1984 | FeJean-Jacques | 507/103 |
| 4,708,212 | A | 11/1987 | McAuley et al. | |
| 4,807,469 | A | 2/1989 | Hall | |
| 4,904,603 | A | 2/1990 | Jones et al. | |
| 5,571,962 | A | 11/1996 | Georgi et al. | |
| 5,665,538 | A | 9/1997 | Slater et al. | |
| 5,763,176 | A | 6/1998 | Slater et al. | |
| 5,811,152 | A | 9/1998 | Cleary | |
| 7,293,715 | B2 | 11/2007 | Bargach et al. | |
| 7,424,910 | B2 | 9/2008 | Xu et al. | |
| 7,635,033 | B2 | 12/2009 | Lynde | |
| 7,762,131 | B2 * | 7/2010 | Ibrahim et al. | 73/152.55 |
| 8,104,338 | B2 * | 1/2012 | DiFoggio | 73/152.55 |
| 2005/0252286 | A1 | 11/2005 | Ibrahim et al. | |
| 2009/0151939 | A1 | 6/2009 | Bailey et al. | |
| 2010/0065463 | A1 | 3/2010 | Taylor | |
| 2010/0193184 | A1 | 8/2010 | Dolman et al. | |
| 2011/0006110 | A1 | 1/2011 | Cleary et al. | |

FOREIGN PATENT DOCUMENTS

| | | | |
|---|---|---|---|
| ES | 2280205 | T3 | 9/2007 |
| FR | 2800384 | A1 | 5/2001 |
| GB | 2319337 | A | 5/1998 |
| GB | 2472371 | A | 2/2011 |

OTHER PUBLICATIONS

PCT/US2012/043570—International Search Report dated Jan. 25, 2013.

* cited by examiner

*Primary Examiner* — William P Neuder
(74) *Attorney, Agent, or Firm* — Mossman, Kumar & Tyler PC

(57) ABSTRACT

A method for estimating a depth from which cuttings have been recovered from a well may include varying a parameter of one or more marking agents added into a drilling fluid circulated into the well and recovering the cuttings from the well. The depth may be estimated by estimating a value associated with the marking agent that marks the cuttings. A system for estimating a depth from which cuttings have been recovered from a well includes at least one marking agent configured to mark the cuttings and a marking agent dispensing device configured to add the at least one marking agent into a drilling fluid circulated into the well. The marking agent dispensing device may be further configured to vary a parameter of the at least one marking agent.

20 Claims, 3 Drawing Sheets

ESTIMATING DRILL CUTTING ORIGINATION DEPTH USING MARKING AGENTS

BACKGROUND OF THE DISCLOSURE

1. Field of the Disclosure

This disclosure relates generally to using marking agents for obtaining information relating to subterranean formations.

2. Description of the Related Art

Fluid logging, also known as hydrocarbon well logging, is a process by which the formation surrounding a borehole is characterized by analyzing the bits of rock or sediment and released reservoir fluids brought to the surface by a circulating drilling medium. This analysis can establish lithology and mineralogy records that are subsequently used by geologists, petrophysicists, completions engineers, reservoir engineers, etc. The value of cutting analysis may be increased if the origination depth of the cutting can be determined. In one conventional method, the cutting origination depth can be estimated based on the time it takes the cutting reach the surface (the lag time). This method typically correlates the depth of the bit at a particular time with the amount of time until the cutting comes to surface. Other conventional methods involve analyzing signature characteristics of the formation and then correlating cuttings to that signature. These conventional methods may be undesirable to due to costs, complexity, limited accuracy, and/or unfavorable well geometries.

The present disclosure addresses the need for more efficient and accurate devices and methods for estimating the originating depth of drill cuttings, as well as other needs of the prior art.

SUMMARY OF THE DISCLOSURE

In aspects, the present disclosure provides a method for estimating a depth from which cuttings have been recovered from a well. The method may include varying a parameter of at least one marking agent added into a drilling fluid circulated into the well; recovering the cuttings from the well; estimating a value associated with the at least one marking agent that marks the cuttings; and estimating the depth using the estimated value associated with the at least one marking agent.

In aspects, the present disclosure provides a system for estimating a depth from which cuttings have been recovered from a well. The system may include at least one marking agent selected to mark the cuttings; and a marking agent dispensing device configured to add the at least one marking agent into a drilling fluid circulated into the well. The marking agent dispensing device may be further configured to vary a parameter of the at least one marking agent.

Illustrative examples of some features of the disclosure thus have been summarized rather broadly in order that the detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DETAILED DESCRIPTION OF THE DISCLOSURE

Figure 1:
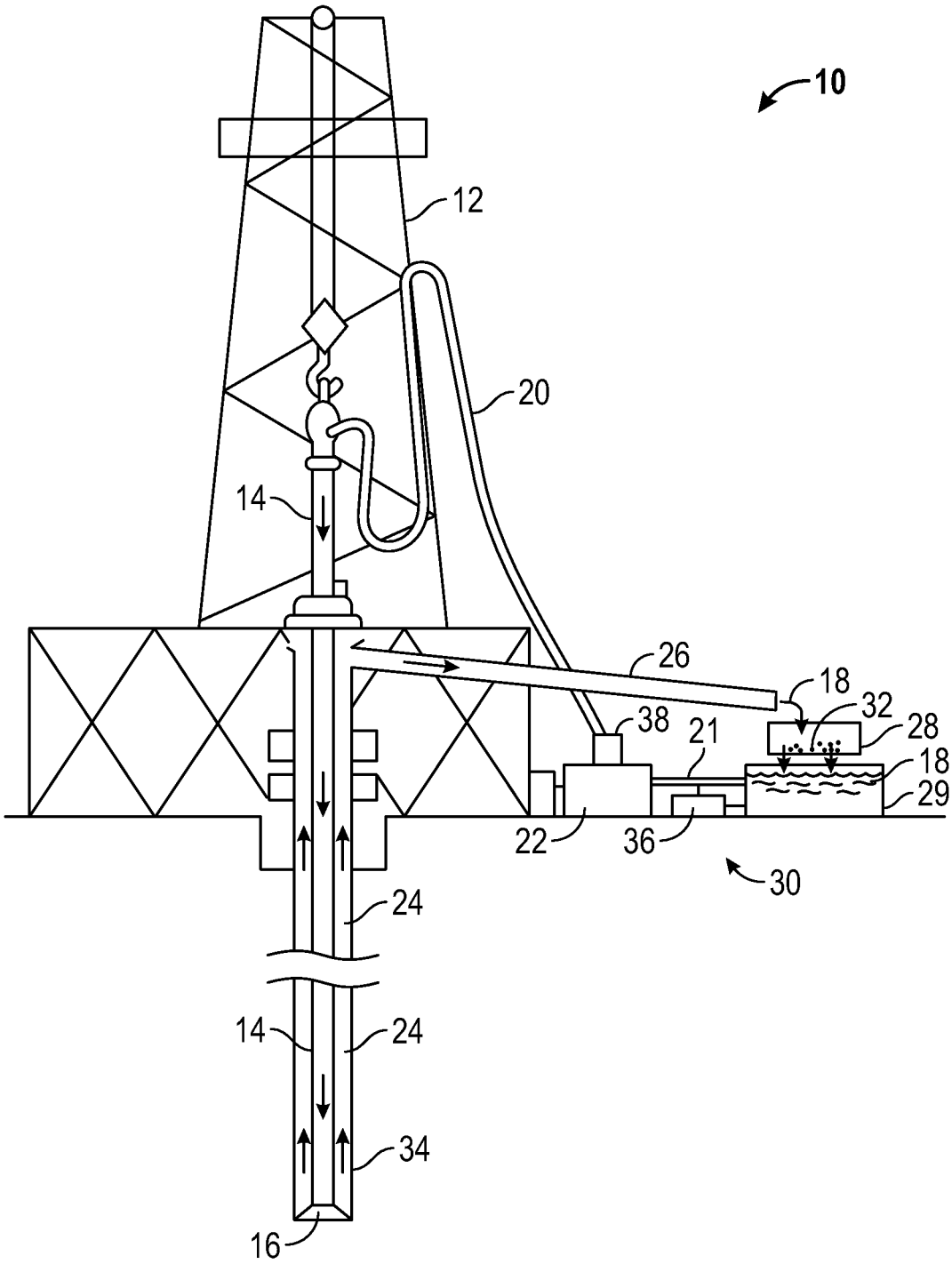
FIG. 1 illustrates an exemplary drilling system that includes a device for estimating the originating depth of cuttings according to one embodiment of the present disclosure.

The present disclosure relates to devices and methods for estimating an originating depth of drill cuttings using one or more marking agents (or, 'agents'). As used herein, an agent may be a solid, granular solid, liquid, gas or mixtures thereof. An agent may be inert or active (e.g., chemical, radioactive, electrical, etc.). The originating depth may be estimated by measuring or evaluating a parameter related to the agent (e.g., concentration, concentration ratio, etc.) The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein.

Referring now to FIG. 1, there is shown an embodiment of a drilling system 10 for drilling boreholes. While a land-based rig is shown, these concepts and the methods are equally applicable to offshore drilling systems. A typical well facility may include a conventional derrick 12 with a drilling string 14 that includes a drill bit 16 at a distal end. A drilling fluid 18 may be pumped into the drill string 14 via a suitable supply line 20 by using fluid pump(s) 22. The drilling fluid 18 flows downwardly within the drill pipe assembly, passes through the orifices in the drill bit 16 and then flows upwardly through an annular space 24 to the surface. The returning drilling fluid 18 then flows through a line 26 which dumps into a small fluid reservoir and then flows onto cuttings separator 28, e.g., a shaker screen. The separator 28 separates drill cuttings 32 from the drilling fluid 18. From the separator 28, the separated drilling fluid 18 passes into a fluid pit(s) 29. It should be understood that the drilling system 10 has been illustrated in a rather simplified fashion and that other equipment, which is known to those skilled in the art, may be included.

The drilling system 10 may include cuttings depth estimation system 30 for estimating an originating depth for the cuttings 32 recovered from the drilled borehole 34. As used herein, the term originating depth refers to the location of the rock and earth making up the drill cutting prior to being disintegrated by the drill bit 16. Also, as used herein, the term cuttings refers to any subterranean rock recovered from the wellbore, whether generated during drilling or some time afterwards as by spalling. The cuttings depth estimation system 30 may include a marking agent dispensing device 36 and a marking agent detection unit 38.

An illustrative agent dispensing device 36 may be configured to inject one or more marking agents into the drilling fluid 18 pumped into the borehole 34. In the embodiment shown, the dispensing device 36 adds the agents to a flow line 21 that conveys drilling fluid 18 from the fluid pit 29 to the fluid pumps 22. The dispensing device 36 may also add agents directly into the fluid pit 29, into the supply line 20, and/or any other suitable location. The dispensing device 36 controls the injection rate in order to adjust the concentrations of the added agents. For instance, the dispensing device 36 may vary, e.g., increase or decrease, the injection rate in order to vary the concentration of the added agent(s) in the drilling fluid 18. The dispensing device 36 may include suitable equipment and circuitry to record the amount of agents being added into the drill string.

In embodiments where the parameter for estimating depth is concentration ratios, the agent detection unit 38 is configured to estimate the concentrations of the agents in the drilling fluid 18 flowing into the drill string 14. In one arrangement, the detection unit 38 may continually measure and record the concentrations of the added agents(s). Other information such as time, flow rates, pressure, and other operating and environmental parameters may also be recorded by the detection unit 38. In some arrangements, the detection unit 38 may be in communication with the dispensing device 36 in order to precisely control the concentration(s) of the added agent(s). That is, the dispensing device 36 may increase or decrease the amount of added agent(s) in order to maintain a desired concentration ratio and/or a desired change in concentration ratio.

Figure 2:
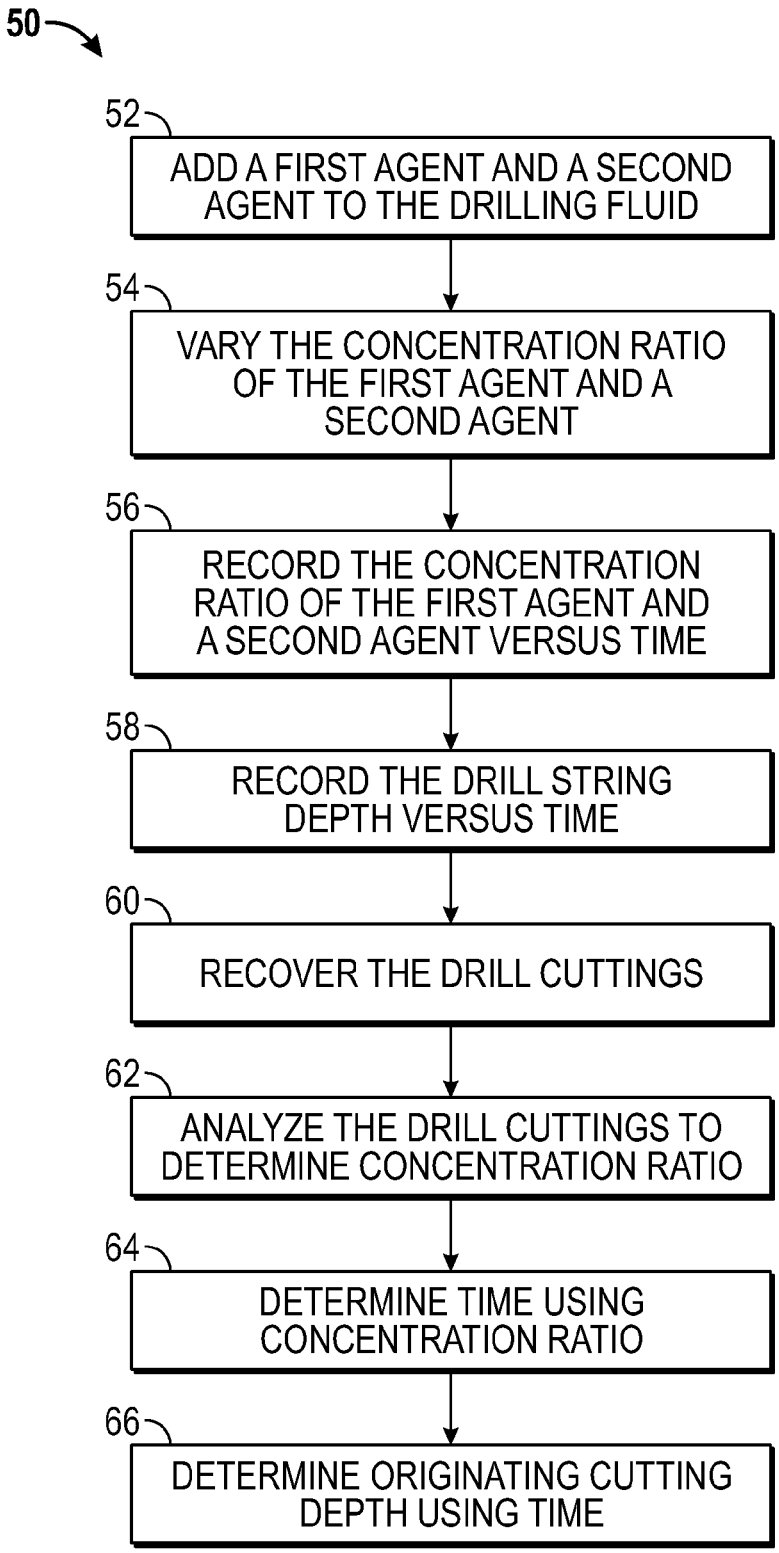
FIG. 2 schematically illustrates a method for estimating originating cutting depth in accordance with one embodiment of the present disclosure.

Referring now to FIG. 2, there is shown one illustrative and non-limiting method 50 for estimating origination depth. The method 50 may include a step 52 of adding a first agent and a second agent into the drilling fluid pumped into the borehole. The addition is performed in a manner that the agents become homogenized (i.e., evenly distributed) in the drilling fluid 18 (FIG. 1). Homogenizing the agents helps to reduce irregularities in the concentration ratio of the two agents. At step 54, the relative concentration of the two agents in the drilling fluid 18 (FIG. 1) is varied with time. The changing concentration ratio of the two agents gives the drilling fluid a "signature" with time. Moreover, the ratio is varied such that a particular ratio occurs only once during a given time period. At step 56, these ratio values are recorded with respect to time. At step 58, the depth of the drill bit 16 (FIG. 1) also is recorded with respect to time. It should be understood that steps 52-58 may be occurring concurrently.

Referring to FIGS. 1 and 2, as the drill bit 16 progresses into a formation, the circulating drilling fluid delivers the agents to the freshly formed cuttings 32 generated by the drill bit 16. The agents may mark the cuttings by penetrating into and affix themselves to the cuttings 32. The agents may mark the borehole walls in a similar manner. Alternatively or additionally, the drilling fluid 18 may act as a connecting material that affixes the agents to the surface of the cuttings 32 to thereby mark the cuttings 32. In either case, it should be appreciated that the cuttings 32 and borehole walls have been marked with a "time-stamp," which is a unique concentration ratio of affixed agents for future reference.

Referring to FIG. 2, at step 60, the drill cuttings are recovered at the surface. At step 62, the cuttings are analyzed to estimate the concentration ratio of the agents affixed to drill cuttings. The tools or instruments used to estimate the concentration ratio depend on nature of the marking agent. In some embodiments, an un-aided visual inspection may suffice. In other embodiments, analysis devices such as optical instruments, spectroscopy tools, chromatography tools, and radiation detectors may be used. The analyses may be done at the surface in "real time," locally, and/or at a remote laboratory. At step 64, the estimated ratio may be correlated with the concentration ratio values versus time data to estimate the time at which the drill cuttings were generated. At step 66, the estimated time is correlated with the depth versus time data to estimate the origination depth. The cuttings may be marked and tagged to create a "core of cutting". These cuttings may be analyzed to determine a lithology profile and retained for future analysis. These correlations may be performed by an information processing device associated with the cuttings depth estimation system 30 (FIG. 1) or another component associated with the drilling system 10 (FIG. 1). As used herein an information processing device may be a general purpose computer, processor, or other similar device that uses programmed algorithms and/instructions to process information.

In certain embodiments, the concentration ratio is not monitored in real time. Rather, the rate of change of the concentration ratio is maintained to provide the desired resolution of the depth. The resolution may be a function of the concentration ratios and the precision of detection of the marking agents. In such arrangements, samples of the drilling fluid may be taken and retained at specified time intervals. For example, the agent detection unit 38 of FIG. 1 may be configured to periodically or continuously sample the drilling fluid being pumped into the borehole. These samples may be analyzed to establish a concentration ratio versus time reference database. Thereafter, the cuttings are analyzed to estimate the concentration ratio of the marking agents, which then are correlated to the reference database. The concentration ratios could be interpolated as needed between sample points.

Further, it should be appreciated that the method 50 may be implemented in a variety of schemes. For example, the variation of the ratio may be performed by using an invariant concentration of the first agent. The first agent may be mixed into a prepared batch of drilling fluid or injected into the drilling fluid being circulated into the well. Also, in situations where the drilling fluid composition changes, a pre-existing amount of the first agent may be supplemented by a continuous or periodic injection of additional amounts of the first agent to ensure that the concentration of the first agent does not vary. The concentration of the second agent may be continuously or periodically increased through a constant injection of the second agent into the drilling fluid. Thus, unique ratio of the two agents exists in continuously or in a stepped fashion in the downwardly flowing drilling fluid.

Figure 3:
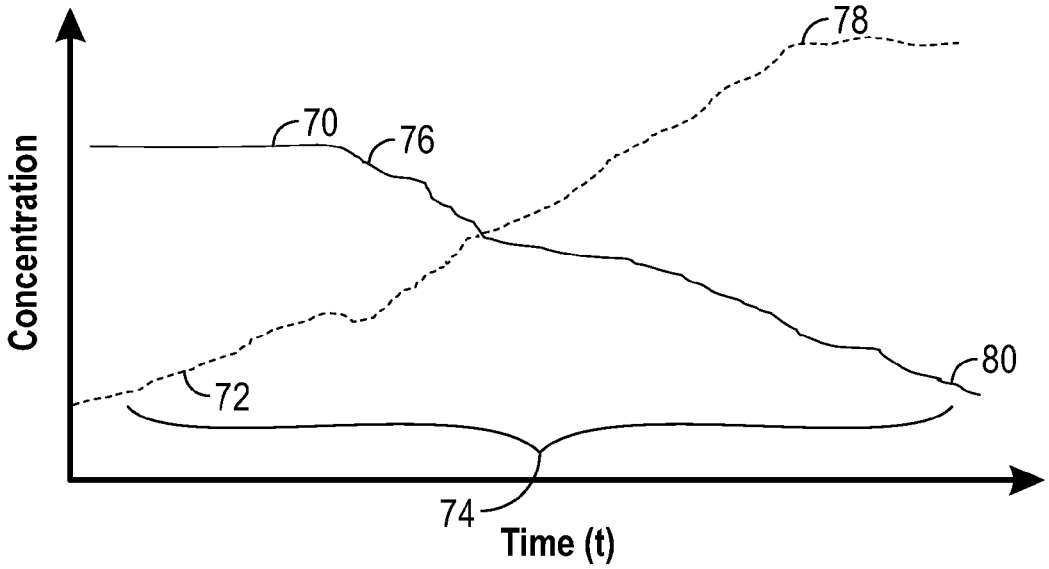
FIG. 3 is a graph showing lines for illustrative agent concentrations over a selected time period.

Referring now to FIG. 3, there is shown a graph illustrating an exemplary change in agent concentration during the course of a typical drilling operation. FIG. 3 shows lines 70, 72 representing the concentrations of first and second agents, respectively, over a selected time period 74. In this methodology, the concentration of the first agent 70 is initially held steady by due to a constant flow rate and fixed drilling fluid composition. However, at time 76, the drilling fluid is reweighted and additional drilling fluid is added. This may have the result of decreasing the concentration of the first agent 70 over time. The concentration of the second agent 72 is increased over time. The slope of the second agent 72 line is dependent on injection rate versus total batch volume and should be fairly constant with constant injection rate. FIG. 3 also illustrates other considerations such as a saturation level 78 for the second agent concentration 72 and a detection limit 80 for the first agent 70. The concentrations of the agents should be kept within the saturation level and detection limit to allow the concentration ratios to be accurately determined.

Figure 4:
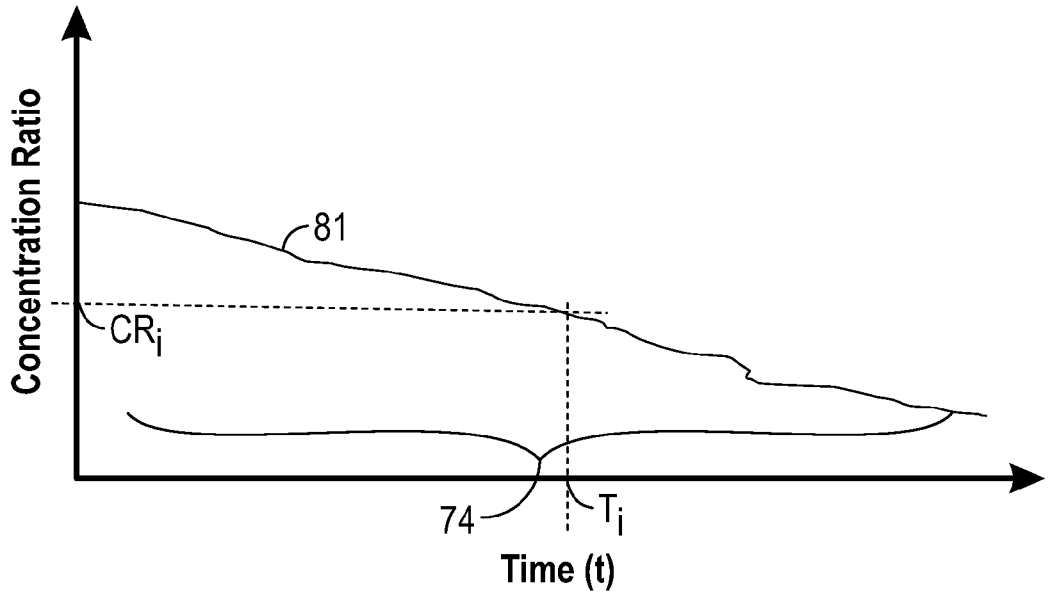
FIG. 4 illustrates a representative line for concentration ratio values associated with the FIG. 3 agent concentrations for the selected time period.

FIG. 4 shows a line 81 of illustrative concentration ratios for the time period 74 for the first and the second agents 70, 72 (FIG. 1). In this instance, the concentration ratio is the concentration of the first agent 70 divided by the concentration of the second agent 72. It should be appreciated that the concentrations of the agents 70, 72 are varied such that, for the most part, a particular concentration ratio occurs only once during the time period 74. For example, a concentration ratio $CR_i$ only occurs once during the time period 74 at time $T_i$.

A variety of agents may be used in connection with the methods of the present disclosure. Generally, the agents should disperse evenly and homogenously into the drilling fluid. Moreover, the agents should have one or more properties or characteristics that are detectable over a range of concentrations. Also, the agents should possess properties that can be engineered to distinguish a substance that could pre-exist in the drill cuttings. Illustrative agents include, dyes, isotopes, fluorescent dyes responsive to electromagnetic energy, radioactive materials, nano particles, synthetic DNA, tracers, etc. Synthetic DNA, as used herein, is a combination of biosynthesized DNA or any other combination of materials. Synthetic DNA may or not may also contain microdots with unique serial numbers that can be optically identified (e.g., under microscopic examination). In certain embodiments, the agent may be a weighting agent (e.g., barite, hematite, illuminate, magnesium tetroxide). Such illustrative agents include one or more engineered parameters (e.g., radioactivity, EM energy responsiveness, patterns, etc.) that can be formulated or designed to have a specific distinguishable characteristic.

Additionally, parameters other than ratios of agent concentrations may be used to "time stamp" the drill cuttings. In some embodiments, the two agents may interact to produce a measurable parameter. For example, optical parameters may be used by combining two or more agents to produce a color. Varying the concentration of one or more of the agents may change the produced color. Thus, each depth or segment of depth may be "time-stamped" with a specific color. The colors may be selected to provide a relatively dramatic or easily discernable change, e.g., from red to purple to green. The colors may be either discernable with or without the use of instruments. It should be appreciated that if the weighting agents were colorized, then separate marking agents may not need to be added to the drilling fluid. In other embodiments, the interaction of the two agents may cause a specific change to an electric property (e.g., impedance).

Embodiments of the present disclosure may be used with oil-based drilling fluid (OBM) or other similar fluid that allow the drill cuttings to remain intact and physically well defined. In certain applications, using water-based drilling fluids may cause the drill cuttings to decompose into a sludge or liquid-like state.

In embodiments, the agents may be formulated to interact with the materials making up the cuttings. For example, the agents may be selected to preferentially attach to shale or clay. Moreover, the agents may be formulated to be hydrophilic or hydrophobic.

It should be appreciated that methods according to the present disclosure do not require dedicated equipment downhole equipment to "stamp" the cuttings or require variances in the normal operating procedures for drilling. Furthermore, it should be appreciated that methods of the present disclosure are not particularly sensitive to well geometry. For instance, embodiments of the present disclosure may be useful in deviated wells (e.g., horizontal wells) wherein the transport of the cutting to the surface by the drilling fluid is complicated by settling along the bottom of the pipe and by dune formation. Because the cuttings have been "stamped," the originating depth of the cuttings may be determined irrespective of when the cutting actually emerges from the borehole. This is in contrast with prior art lag time techniques that rely on cuttings emerging from the borehole at a specified time.

As noted previously, the borehole wall may be "stamped" with the marking agents. Often, portions of the borehole may spall off some time after the drill bit first cut that section of hole. Knowing the origination depth of these "cuttings" would give additional lithology information and important information about the integrity of different sections of the well. Prior art lag time cannot be used to estimate the depth of spalled cuttings, because the time of release and transport time to surface is not known.

In the embodiments discussed above, two agents are used. It should be appreciated that three or more agents may also be used. For instance, three agents may be used when one agent becomes saturated or falls below the detection limit. In such a situation, the new agent may be added in a steady non-varying amount or varied as needed to generate a unique concentration ratio. Further, one agent may be used if the property of the agent could be changed with time. Since drilling fluid is usually circulated and re-used, if the property of the agent is changed there is a concern that residual material might be analyzed instead of the new material. This could be addressed by sterilized or deactivating an agent (e.g., via microwaves, radiation, chemicals, heat etc) prior to injecting the new material.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure. It is intended that the following claims be interpreted to embrace all such modifications and changes.

We claim:

1. A method for estimating a depth from which cuttings have been recovered from a well, comprising:

adding a first marking agent and a second marking agent into a drilling fluid;

maintaining a concentration of the first marking agent above a detection level;

maintaining a concentration of the second marking agent below a saturation level;

varying a parameter of at least one of the first marking agent and the second marking agent added into a drilling fluid circulated into the well;

recovering the cuttings from the well;

estimating a value associated with the first and the second marking agents that mark the cuttings; and estimating the depth using the estimated value associated with the first and the second marking agents.

2. The method of claim 1, wherein the parameter of the first marking agent is controlled to provide a relatively steady concentration and the parameter of the second marking agent is varied to cause a set of unique values associated with the first and the second marking agents over a selected time interval.

3. The method of claim 2, further comprising correlating the set of unique values with a set of depth values such that each depth value has an associated unique value.

4. The method of claim 1, wherein the estimated value is a ratio of the first and the second marking agents that mark the cuttings.

5. The method of claim 1, further comprising:

adding an additional marking agent to the drilling fluid circulated into the well, wherein the estimated value is a ratio of an amount of the first and the second marking agents and an amount of the additional marking agent.

6. The method of claim 1, further comprising:

adding a plurality of additional marking agents to the drilling fluid circulated into the well, wherein the estimated value is a ratio of an amount of the first and the second marking agents and an amount of at least one additional marking agent of the plurality of additional marking agents.

7. The method of claim 1, wherein the estimated value is related to a material formed by the interaction of the first and the second marking agents.

8. The method of claim 1, wherein the first and the second marking agents are one of: (i) a particulated material, (ii) a fluid, (iii) gas, and (iv) a liquid.

9. The method of claim 1, wherein the parameter is one of: (i) quantity, (ii) a material property, (iii) an optical property, (iv) a chemical property; and (v) an engineered property.

10. A system for estimating a depth from which cuttings have been recovered from a well, comprising:

a first marking agent and a second marking agent, each marking agent being configured to mark the cuttings; and a marking agent dispensing device configured to add the first marking agent and a second marking agent into a drilling fluid circulated into the well, the at least one marking agent dispensing device being further configured to vary a parameter of at least the second marking agent.

11. The system of claim 10, wherein the at least one marking agent includes a first and a second marking agent and wherein the marking agent dispensing device is configured to vary an amount of the first marking agent in the drilling fluid.

12. The system of claim 10, wherein the marking agent dispensing device is configured to record a parameter of the at least one marking agent being added to the drilling fluid.

13. The system of claim 10, wherein the marking agent dispensing device is configured to cause a set of unique parameter values over a selected time interval.

14. The system of claim 13, further comprising an information processing device configured to correlate the set of unique parameter values with depth such that each depth value has an associated unique parameter value.

15. The system of claim 10, wherein the parameter is one of: (i) quantity, (ii) a material property, (iii) an optical property, (iv) a chemical property; and (v) an engineered property.

16. A system for estimating a depth from which cuttings have been recovered from a well, comprising:

at least one marking agent configured to mark the cuttings;

a marking agent dispensing device configured to add the at least one marking agent into a drilling fluid circulated into the well, the at least one marking agent dispensing device being further configured to vary a parameter of the at least one marking agent, wherein the marking agent dispensing device is configured to record a parameter of the at least one marking agent being added to the drilling fluid.

17. The system of claim 16, wherein the at least one marking agent includes a first and a second marking agent and wherein the marking agent dispensing device is configured to vary an amount of the first marking agent in the drilling fluid.

18. The system of claim 16, wherein the marking agent dispensing device is configured to cause a set of unique parameter values over a selected time interval.

19. The system of claim 18, further comprising an information processing device configured to correlate the set of unique parameter values with depth such that each depth value has an associated unique parameter value.

20. The system of claim 16, wherein the parameter is one of: (i) quantity, (ii) a material property, (iii) an optical property, (iv) a chemical property; and (v) an engineered property.

* * * * *